US005405249A

United States Patent [19]

Benson

[11] Patent Number: 5,405,249

[45] Date of Patent: Apr. 11, 1995

[54] GAS SUPPLY APPARATUS

[75] Inventor: Trevor P. Benson, Evesham, Great Britain

[73] Assignee: Ultra Electronics Limited, Greenford, United Kingdom

[21] Appl. No.: 149,802

[22] Filed: Nov. 10, 1993

[30] Foreign Application Priority Data

Nov. 11, 1992 [GB] United Kingdom ..... 9223606

[51] Int. Cl.[6] ..... F15B 21/09; F04B 53/00

[52] U.S. Cl. ..... 417/313; 417/423.11; 92/78; 277/70

[58] Field of Search ..... 417/313, 423.11; 92/78; 184/6.24; 96/133; 95/130; 277/1, 17, 18, 70

[56] References Cited

U.S. PATENT DOCUMENTS 3,532,444 10/1970 Strub ..... 417/423.11
3,975,123 8/1976 Schibbye ..... 277/70
4,273,509 6/1981 Erickson et al. ..... 184/6.24
4,584,001 4/1986 Dechene ..... 96/133
4,621,981 11/1986 Lorett ..... 417/423.11
4,673,415 6/1987 Stanford ..... 95/130
4,734,018 3/1988 Taniyama et al. ..... 277/70

*Primary Examiner*—Richard A. Bertsch
*Assistant Examiner*—Peter Korytnyk
*Attorney, Agent, or Firm*—Young & Thompson

[57] ABSTRACT

A gas supply apparatus (1) particularly for supplying oxygen comprises a gas separator (2) for separating oxygen from the other constituents of the air. The oxygen passes to a piston cavity (6) of a compressor unit (7) where it is compressed and passed to a storage means (12) from where it can be dispensed via a pressure regulator (13) to a number of emergency oxygen masks (14). The compressor unit (7) includes a number of moving parts lubricated by oil within a first cavity (8). Cavity (8) is separated from the piston cavity (6) by a purge cavity (9). In the event of an oil leak from the first cavity (8), the oil will gather in the purge cavity (9) where it is purged therefrom by the waste gas from the separator unit (2) after the oxygen has been removed. If any of the waste gas leaks from the purge cavity (9) into the piston cavity (6) it will mix with the oxygen compressed therein and form a safe mixture.

6 Claims, 2 Drawing Sheets

GAS SUPPLY APPARATUS

TECHNICAL FIELD

This invention relates to a gas supply apparatus and, particularly, but not exclusively, an oxygen supply apparatus for an aircraft.

Civil passenger carrying aircraft are provided with an onboard oxygen supply apparatus for emergency use, for example, during cabin decompression. The apparatus comprises a number of oxygen storage tanks or bottles which are charged with oxygen from a ground crew operated supply tank, whilst the aircraft is on the ground. International safety regulations do not permit passenger carrying aircraft to take off unless the onboard apparatus is fully charged. Thus delays can occur in aircraft taking off due to the non-availability of oxygen supply tanks or the ground crew to operate them.

Compact compressor units are already known which are light enough to be carried by aircraft. However, it has not been possible to use them to supply oxygen to the onboard apparatus because of the danger of oxygen leaking from the compressor and mixing with lubrication oil. The resulting mixture of oil with oxygen is highly dangerous because of its inflammable or explosive nature.

SUMMARY OF THE INVENTION

It is an object of the invention to provide an oxygen supply apparatus including a compressor in which the danger of such leakage is substantially reduced or eliminated.

Accordingly, the invention in its broadest aspect provides a gas supply apparatus comprising: separator means to separate a desired gas from a mixture of gases and supply the desired gas to a desired gas output and a waste gas to a waste gas output; a compressor comprising a piston cavity connected to the desired gas output and containing at least one compressor piston to compress the desired gas and supply this to a compressed gas output, a purge cavity having a purge input connected to the waste gas output and a purge output so that waste gas purges any of the desired gas that leaks into the purge cavity from the piston cavity.

This is particularly advantageous where the mixture of gases is air from which is separated oxygen. The waste gas of the separation process will then be the remaining constituents of air that is mostly nitrogen and carbon dioxide with traces of other gases. This will be substantially inert. Thus the lubrication oil purge gas mixture is substantially inert presenting a non-flammable mixture. In the worst possible case of a complete leakage of oxygen past the piston into the purge cavity, the resulting purge output will be compressed air which, because it only has a low concentration of oxygen, and is therefore less hazardous.

Preferably, the purge cavity comprises a cavity disposed between a first cavity containing lubricated parts of the compressor and the piston cavity so that waste gas purges any lubricant that leaks into the purge cavity from the first cavity.

Thus in the case of the mixture of gases being air from which oxygen is separated, the lubricant is purged by a waste gas which is inert. The purged output produced is substantially non-combustible because of the inert gas significantly reducing the risk of explosion. If oxygen leaks into the purge cavity from the piston cavity, in the worst possible case the concentration of oxygen will not exceed that of the air from which it is separated. The worst possible case purge output will therefore only have the same combustibility as an air/lubricant mixture.

The apparatus will, conveniently, include storage means connected to the compressed gas output to store compressed gas supplied therefrom. Suitable storage means includes gas bottles although any other known other means may be used.

BRIEF DESCRIPTION OF THE DRAWINGS

A specific embodiment of the invention will now be described, by way of example only, with reference to the accompanying drawings in which.

DETAILED DESCRIPTION OF THE INVENTION

Figure 1:
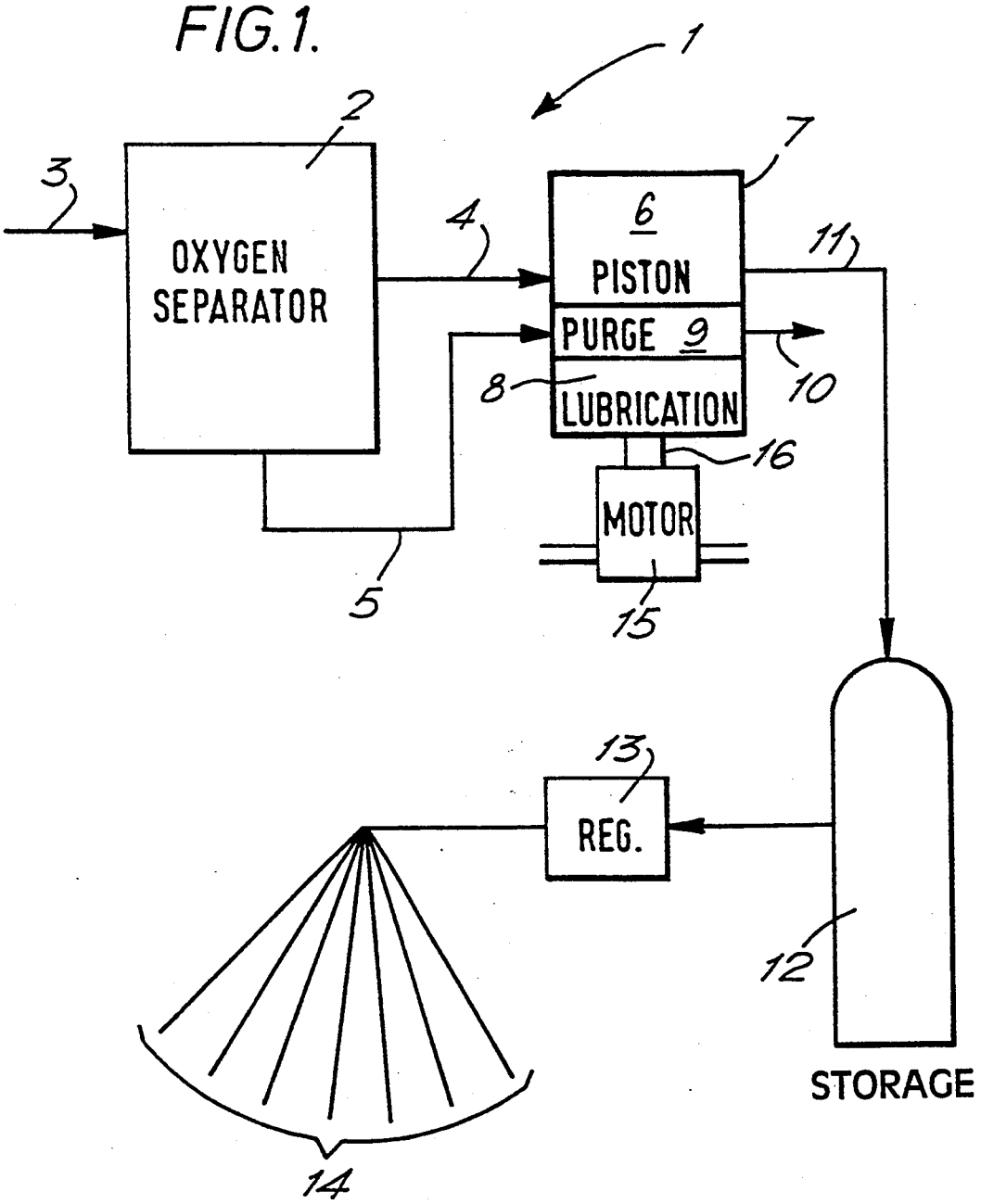
FIG. 1 shows a schematic block diagram of an apparatus in accordance with the invention.

With reference to FIG. 1, a gas supply apparatus 1 for supplying oxygen is located on board a passenger aircraft (not shown) and comprises an oxygen separator unit 2 having an air input 3, an oxygen output 4 and a waste gas output 5. The air input into the apparatus is derived from the aircraft's engine in a known manner. The oxygen output 4 is connected to a piston cavity 6 of a compressor unit 7 comprising a piston cavity body 27 defining the cavity 6, a piston head 50 connected via a sealed joint 52 to the body 27, and pistons 17,18 operating within the cavity 6.

The compressor unit 7 has two other main cavities, a first cavity 8 containing those parts which are lubricated, and a purge cavity 9 comprising an inner purge cavity 9*a* and an outer purge cavity 9*b*. The inner purge cavity 9*a* separates the piston cavity 6 from the first cavity 8. The outer purge cavity 9*b* is defined by an outer sleeve 49 surrounding the sealed joint 52 between the piston head 50 and the piston cavity body 27. These two purge cavities are interconnected via a port 46. The waste gas output 5 of the separator unit 2 is connected via an inlet port 51 to the outer purge cavity 9*b* and the inner purge cavity 9*a* is connected via an outlet port 47 to a purge output 10.

The piston cavity 6 has a compressed gas output 11 which is connected to a storage bottle 12. A pressure regulator 13 is connected between the storage bottle 12 and a plurality of oxygen masks 14 stored above the seat positions (not shown). The masks 14 are deployable (in a manner well known) to be worn in an emergency by the passengers. An electric motor 15 supplied with electrical power from the aircraft's generating apparatus, provides the necessary motive force to the compressor 7 by a shaft 16.

Figure 2:
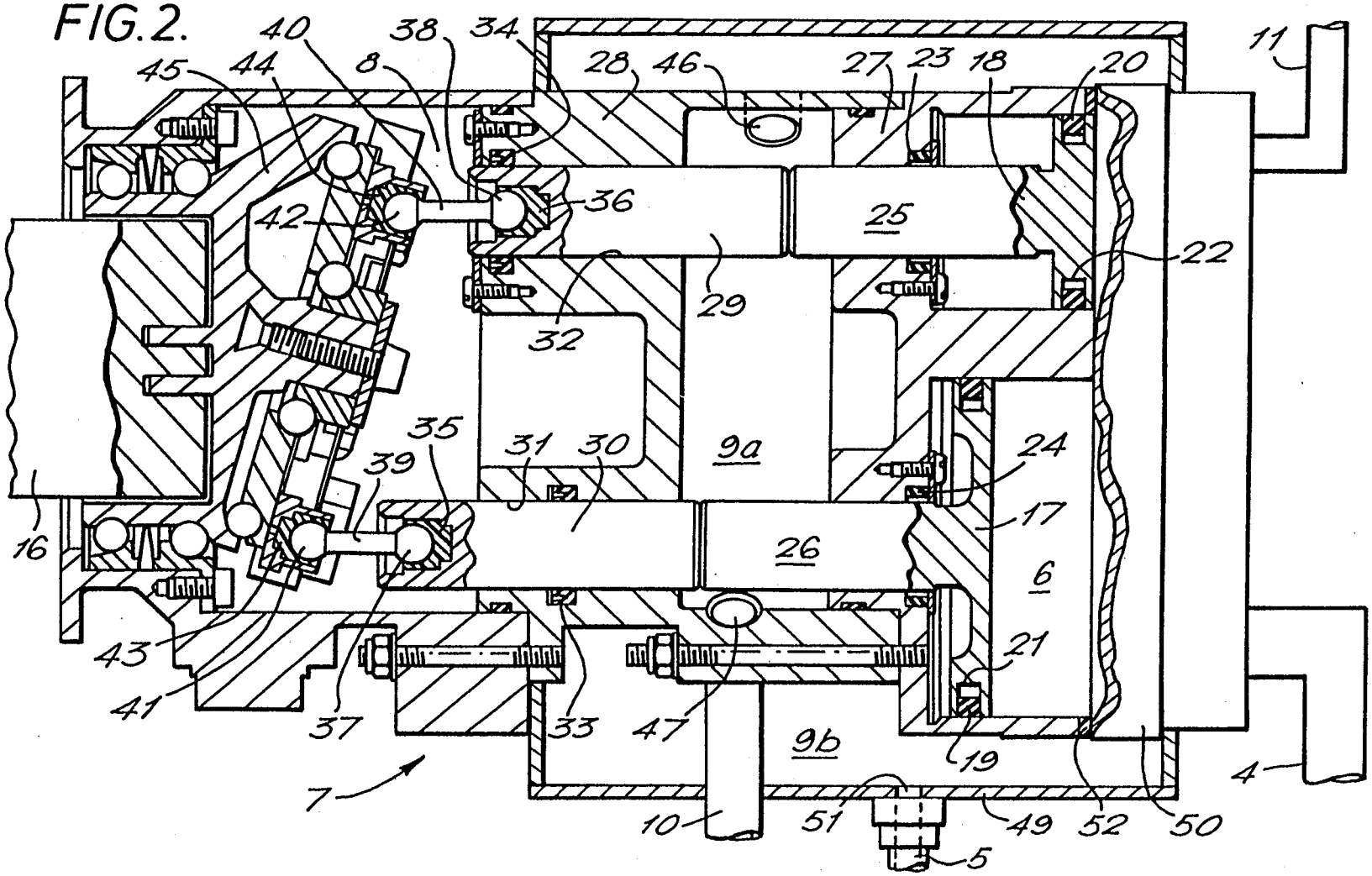
FIG. 2 shows a partial longitudinal cross-section through a compressor used in the apparatus shown in FIG. 1.

The compressor unit 7 is shown in greater detail in FIG. 2. The piston cavity 6 includes four pistons two of which pistons 17, 18 are shown. The pistons are progressively sized, piston 17 is the largest, piston 18 the second largest, the pistons not shown are the third largest and the smallest pistons. The pistons are interconnected by a valve arrangement, in a manner well known, to provide four successive stages of compression in a way to be described later. The pistons have annular piston head seals 19, 20 held in peripheral grooves 21, 22 of the piston heads. Annular elastomeric seals 23, 24 seal between piston rods 25 and 26 and the piston cavity body 27.

The piston rods 25, 26 pass through the body 27 into the inner purge cavity 9*a* defined by a purge cavity defining body 28 and the body 27. Abutting the ends of each piston rod is a piston actuator 29, 30 two of the four of which are shown. The piston actuators 29, 30 are axially slidably located in cylindrical bores 31, 32 formed in the inner purge cavity defining body 28. Elastomeric material oil seals 33 and 34 form seals between the actuators 29, 30 and the inner purge cavity defining body 28. Each piston actuator 29, 30 has located in one end a plastics material socket 35, 36 into which a ball end 37, 38 of an actuator link pin 39, 40 is retained forming a ball and socket joint. The other end of each actuator link pin 39, 40 is also formed as a ball 41, 42 retained in plastics material sockets 43, 44 in a wobble plate arrangement 45, of a type well known in the art, which is inclined such that as it is rotated by the shaft 16 it axially pulls and pushes the actuator link pins 39, 40. The reciprocating motion thus produced is passed to the pistons 17, 18 compressing oxygen introduced from oxygen output 4. The largest piston 17 provides a first stage of compression, and the oxygen compressed by it is passed by the valve arrangement to the second largest piston 18 where it is further compressed. The compressed air from piston 18 is passed successively to the two other pistons where it is further compressed. The compressed oxygen is delivered from the piston cavity 6 via the compressed gas output 11 to the earlier described storage means 12.

The components of the first cavity 8 are lubricated by oil contained therein. The oil seals 33, 34 are designed to prevent leakage of oil from the first cavity 8 past the piston actuators 29, 30. However, if these seals fail, oil will leak into the inner purge cavity 9*a* from which it is purged through the output 10 by the waste gas (mostly inert nitrogen gas) from the oxygen separator unit 2 via the waste gas output 5, and which flows from the outer purge cavity 9*b* to the inner purge cavity 9*a* through the port 46. Thus any leaked oil is removed before it can leak past seals 23 24, 20, 19 into the piston cavity 6, and the oxygen which is supplied to the passengers. Should the seals 23, 24, 20 and 21, fail any consequential leakage oxygen into the inner purge cavity 9*a* will only result in a gradual increase in the level of the oxygen in the purge output 10. In the worst possible case, the purge output will have the same oxygen concentrations as the air from which is separated. The outer purge cavity 9*b* defined by the outer cylindrical sleeve 49 surrounds the sealed joint 52 between the piston head 50 and the body 27, and collects any oxygen that leaks from the joint. The waste gas supplied by the output 5 to the outer purge cavity 9*b* will therefore also purge this leaked oxygen.

The waste gases from the oxygen separator 2 are therefore used as a purge gas which greatly enhances the safety of the apparatus 1.

I claim:

1. A gas supply apparatus comprising separator means to separate a desired gas from a mixture of gases and supply the desired gas to a desired gas output and a waste gas to a waste gas output, and a compressor incorporating a piston cavity connected to the desired gas output and containing at least one compressor piston to compress the desired gas and supply this to a compressed gas output; and wherein the compressor incorporates a purge cavity having a purge input connected to the waste gas output and a purge output to allow the waste gas purge any desired gas that leaks into the purge cavity from the piston cavity.

2. Apparatus as claimed in claim 1 wherein the purge cavity comprises an intermediate cavity disposed between a cavity containing lubricated parts of the compressor and the piston cavity so that waste gas purges any lubricant that leaks into the purge cavity from the cavity containing the lubricated parts.

3. Apparatus as claimed in claim 1 wherein the piston cavity is defined by a piston cavity body and a piston head with a sealed joint between them, the purge cavity comprising a cavity that surrounds the sealed joint so as to collect any desired gas that leaks through the joint.

4. Apparatus as claimed in claim 2 wherein the piston cavity is defined by a piston cavity body and a piston head with a sealed joint between them, the purge cavity further comprising a second cavity that surrounds the sealed joint so as to collect any desired gas that leaks through the joint, and said intermediate and second cavities being interconnected so that the waste gas flows from one to the other between the purge input and the purge output.

5. Apparatus as claimed in claim 1 wherein the separator means is fluidly connected to a source of air as the mixture of gases, said separator means separating oxygen as the desired gas.

6. Apparatus as claimed in claim 1 including storage means connected to the compressed gas output to store the compressed gas output therefrom.

* * * * *